United States Patent [19]

Lundback

[11] Patent Number: 4,750,868

[45] **Date of Patent: * Jun. 14, 1988**

[54] PUMP WITH CONTINUOUS INFLOW AND PULSATING OUTFLOW

[75] Inventor: Stig Lundback, Vaxholm, Sweden

[73] Assignee: Astra-Tech Aktiebolag, Stockholm, Sweden

[ * ] Notice: The portion of the term of this patent subsequent to Mar. 10, 2004 has been disclaimed.

[21] Appl. No.: 907,451

[22] Filed: Sep. 15, 1986

Related U.S. Application Data

[63] Continuation-in-part of Ser. No. 709,557, Mar. 8, 1985, Pat. No. 4,648,877.

[30] Foreign Application Priority Data

Sep. 20, 1985 [SE] Sweden ..... 8504362

[51] Int. Cl.[4] ..... F04B 3/00; F04B 45/02

[52] U.S. Cl. ..... 417/257; 417/299; 417/412; 417/473

[58] Field of Search ..... 417/244, 257, 472, 473, 417/412, 413, 246, 254–268, 416; 623/3

[56] References Cited

U.S. PATENT DOCUMENTS

| | | | |
|---|---|---|---|
| 385,853 | 7/1888 | Fasoldt | 417/260 |
| 2,019,160 | 10/1935 | Semsch | 417/412 |
| 2,629,538 | 2/1953 | Replogle | 417/416 |
| 2,678,202 | 5/1954 | Brake | 417/413 X |
| 2,830,757 | 4/1958 | Romanoff | 417/412 |
| 3,037,686 | 6/1962 | Kaletsch | 417/266 X |
| 3,097,366 | 7/1963 | Winchell | 417/412 X |
| 3,656,873 | 4/1972 | Schiff | 623/3 |
| 3,950,761 | 5/1976 | Kashio | 417/413 X |
| 4,643,651 | 2/1987 | Couillard | 417/266 X |
| 4,648,877 | 3/1987 | Lundback | 623/3 |

*Primary Examiner*—Carlton R. Croyle
*Assistant Examiner*—Theodore Olds
*Attorney, Agent, or Firm*—Brumbaugh, Graves, Donohue & Raymond

[57] ABSTRACT

A pump with a continuous inflow and a pulsating outflow comprises a first chamber and a second chamber with a passage between them and made at least partly from a flexible material. There is an inlet to the first chamber and an outlet from the second chamber. The passage between the chambers has a one-way valve permitting flow only in a direction from the first to the second chamber. A second one-way valve located at the outlet permits flow only in a direction out of the second chamber. The chambers are movably supported in a pump casing having a first and a second opening. The inlet is connected to and penetrates the first opening, and the outlet is connected to and penetrates the second opening. A drive arrangement reduces the volume of the second chamber to expel the pumped medium while simultaneously enabling the walls of the first chamber to increase the volume and permit the pumped medium to flow through the inlet into the first chamber. The drive means includes a drive ring surrounding the passage and fixed to it, which drive ring has surfaces engageable with the first and the second chamber walls in a way that the medium taken in between periods when the drive means is affecting the chamber walls controls the output of the pump by defining the receding movement of the drive ring, which movement is a function of the differential pressure force resulting from a difference in areas of engagement with the respective chamber walls on opposite sides of the drive ring.

21 Claims, 4 Drawing Sheets

PUMP WITH CONTINUOUS INFLOW AND PULSATING OUTFLOW

REFERENCE TO PRIOR APPLICATION

The present application is a continuation-in-part of U.S. patent application Ser. No. 709,557, now U.S. Pat. No. 4,648,877 filed Mar. 8, 1985, and entitled "Blood Pump."

FIELD OF THE INVENTION

The present invention relates to a pump with continuous inflow and pulsating outflow for use in industry, mining, agriculture, water supply, heating, sanitation, and similar fields.

BACKGROUND OF THE INVENTION

In various industrial and other areas, it is often desirable, and sometimes necessary, to control the flow of the medium to be pumped ("pumped medium") as a function of the prevailing pressure of the pumped medium. For example, where the pumped medium is contained in a reservoir or tank that itself receives a varying supply, the maintenance of a selected fill level requires increasing the pumping rate when the level tends to rise and reducing the pumping rate when the level tends to fall. The pumped medium may be not only water and other liquids but solutions and suspensions of various kinds.

At present, such pumping is controlled by sensors monitoring the pressure of the medium being pumped at the inflow side of the pump. The sensors control the pumping rate of pumps whose capacity may be varied, e.g., piston pumps with a variable stroke rate. Such monitors may cease functioning without the pump necessarily stopping. This results in the pump pumping either too much or too little, possibly resulting in severe consequences with regard to safety. In case safety is decisive, double safety measures have to be incorporated into the design, e.g., by providing duplicate sensors, which will make the pump more expensive and more prone to succumb to electrical faults.

SUMMARY OF THE INVENTION

It is an object of the invention to provide a self-regulating pump which provides a pulsative outflow at essentially continuous inflow and which has a displacement volume that varies according to the pressure of the pumped medium supplied to it. This objective is attained, according to the present invention, by a pump having two chambers, each at least partially formed by flexible walls. There is an inlet to one chamber, an outlet from the other chamber, and a passage between the two, which passage at the same time is the outlet of the first chamber and the inlet of the second chamber. A first one-way valve located in the passage allows flow from the first chamber to the second only, and a second one-way valve located in the outlet from the second chamber allows flow out of the second chamber only. Both chambers are movably supported in a casing with first and second openings, the inlet to the first chamber being fastened in the first opening of the casing and the outlet of the second chamber being fastened in the second opening of the casing. A drive arrangement periodically decreases the volume of the second chamber to expel the pumped medium from it, while simultaneously enabling the volume of the first chamber to increase and to permit inflow of liquid through the inlet of the pump.

The drive arrangement includes a drive ring surrounding the passage between the two chambers and joined to it, which drive ring has a surface engaging the wall of the second chamber over an area that varies in a way that the pressure of the medium to be pumped entering into the chambers of the pump between the pumping strokes of the drive controls the amount of medium being pumped. In particular, the pressure of the medium supplied to the pump determines the extent of the return movement of the drive ring, and thereby the filled volume of the second chamber at the beginning of the delivery stroke, as a function of a pressure-generated force acting over the area of engagement between the drive ring and the walls of the second chamber.

Preferred embodiments of the invention include the following characteristics individually or in combination:

1. The drive arrangement provides a forced displacement of the drive ring only during the delivery stroke, i.e., when expelling pumped medium from the second chamber. During the return stroke, the drive ring is disengaged from the drive arrangement and returns by the above-mentioned pressure-generated force. The retraction of the drive arrangement is provided by the motor, a spring or an equivalent device.

2. The casing is hermetically sealed and contains a compressible fluid, preferably a gas, between it and the pump chambers. The pressure of the fluid varies in accordance with the total volume of both chambers and, therefore, affects the inflow of pumping medium during the return movement of the drive arrangement. The pressure in the space between the casing and the chambers can be controlled by a valve in a port in the casing.

3. The space between the casing wall and the chambers may be in communication with still another closed volume which, e.g., may consist of a completely or partially enclosing envelope around the casing. The enclosed volume communicates with the interior of the casing through a pressure control valve.

4. The first and the second chambers and the passage between them are parts of a hose-like member (sock) provided with enlargements constituting the chambers and made of flexible material, which is preferably also non-elastic. When the hose if enlarged by filling, the enlargements will approximately take the form of a biconvex lens or a sphere.

5. The inlet into the first chamber and the outlet from the second chamber are preferably arranged at opposite ends of the casing and also generally aligned with the passage between both chambers.

6. Both chambers and the passage between them are essentially rotationally symmetrical around an axis of symmetry defined by a line joining the inlet, the passage between both chambers, and the outlet. Also the drive ring and the casing are, preferably, symmetrical with respect to this axis.

7. Parts of the walls of the first and the second chambers will engage with surfaces of the drive ring and interior wall surfaces of the casing, and the surfaces engaging with the walls of each chamber are of generally complementary shape. The drive ring advantageously has the form of a dish. The surface of the drive ring engaging with one of the two chambers is, preferably, convex and that engaging the other chamber is concave. The area of the drive ring engaging the wall of the second chamber during a substantial part of the return stroke of the pump is substantially larger than the area of the drive ring engaging with the first chamber, whereby the volume taken into the pump between pumping strokes of the power transmission acting unidirectionally on the drive ring is a function of the dynamic and static forces of the incoming pumped medium.

As mentioned above, it is desirable for the walls of the two chambers to be not only flexible but also essentially non-elastic. Because it is difficult to find materials with these properties, some elasticity may be tolerated. The walls should be made of a material which is not (or only very slightly) affected chemically by the medium to be pumped, which resists wear and is not soluble and does not swell in the medium, and does not allow substantial diffusion of the medium. Generally, polymeric materials are acceptable, and the polymeric materials can be reinforced by fibres of various kinds. Suitable polymeric materials are, e.g., rubber, silicone rubber, and polyurethanes.

Because of the self-regulating properties of the pump, one can dispense with sensors that control its capacity by, for example, changing the stroke rate. If desired, the pump may, however, be provided with sensors as control elements in addition to the inherent auto-regulation. Two or more pumps may be coupled in series or in parallel while maintaining the self-regulating properties, whereby pumping within complex systems may be achieved by preset pressure values for each individual pump. Such systems with several pumps may be driven synchronously or with different stroke frequencies for different pumps.

The pulsating outflow of the pump may, if desired, be smoothed by arranging next to the outlet an element with flexible walls, preferably also elastic, surrounded by a compressible fluid.

In order to provide a better understanding of the invention, there is given below a description of two non-limiting embodiments, which are illustrated in the attached drawings.

DESCRIPTION OF THE EMBODIMENTS

Figure 1:
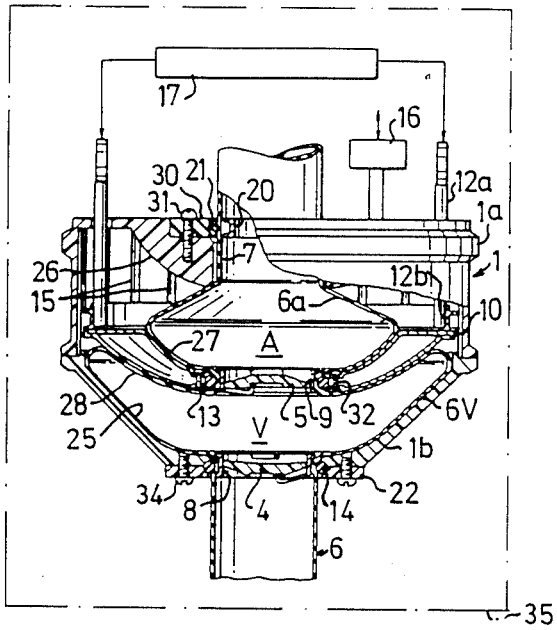
FIG. 1 shows a first embodiment in cross-sectional view taken along the axis of symmetry, and showing certain parts schematically.

The first embodiment (FIGS. 1 to 3) is based on a hose-like member 6 with bulbous enlargements **6*a* and 6*v* shaped like biconvex lenses. The member 6 is made from a material which is flexible but essentially non-elastic. The member 6 is mounted in a casing 1 consisting of parts 1*a* and 1*b*** and may be made from polyurethane reinforced by cellulose acetate fibers.

At the constriction 9 between the enlargements **6*a* and 6*v*, which is a passage between the bulbous chambers, there is mounted a dish-like drive ring 10. Furthermore, two one-way valves are provided, a first one-way valve 5 in the constriction 9 and the other one-way valve 4 in the casing at the outlet from the chamber defined by enlargement 6*v***. The one-way valves can be of various sorts and should be suited to the type of medium to be pumped.

As is evident from the drawings, the hose-like member 6 is connected with other parts of the pump in three places, to wit: with valve 5 in the constriction 9 and with respective openings 7 and 8 in the casing 1. At the opening 7 in the casing, a ring 20 with an external grove is inserted into the hose-like member 6, and a resilient O-ring 21 is mounted in the same place on the outside. A retaining ring 30 secured with screws 31 to the casing 1 keeps the O-ring 21, and thereby the ring 20, in place. Besides their valve function, the valves 4 and 5 also have the function of participating in securing the hose-like member 6 at the drive ring 10 and the opening 8 in the casing 1. Both valves have an outer circular groove which accepts an O-ring and thereby keeps the interposed hose-like member 6 in place. Drive ring 10 consists of two plate-like parts which are pressed against the O-ring 13 and the valve 5, and which are joined by screws 32. The O-ring 14 for the valve 4 is pressed against the casing at the opening 8 by a retainer ring 22 secured in the casing by screws 34.

Figure 2:
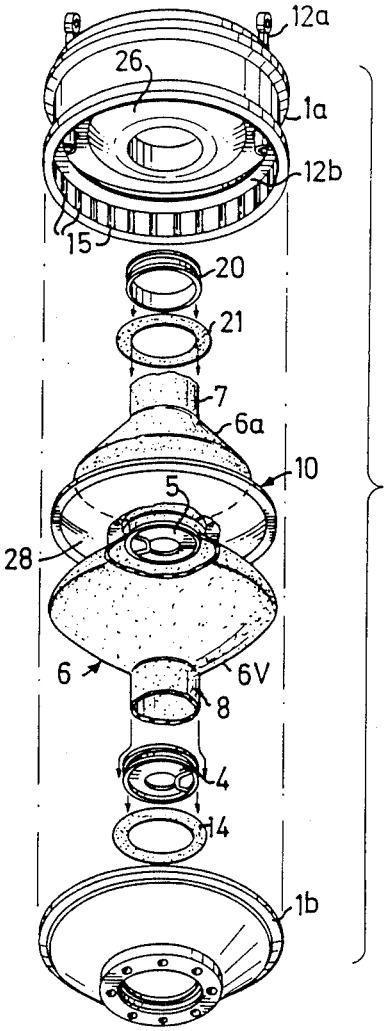
FIG. 2 is an exploded view of the first embodiment.

The entire arrangement in the assembled state is shown in FIG. 1. The drive ring 10 is able to move freely along the walls in the casing 1, which has grooves on its inside permitting free flow of a compressible material (preferably a gas) in the casing between the spaces on either side of the drive ring.

The smaller lens-like enlargement **6*a* on hose 6 defines a first chamber A, and the larger enlargement 6*v* a second chamber V. The inlet to chamber A is mounted in the casing at opening 7**.

The constriction 9 between the two chambers A and V is a passage through which the medium to be pumped can flow only in the direction from chamber A to chamber V through the one-way valve 5. Opening 8 with one-way valve 4 is the outlet of the pump through which the medium to be pumped is discharged under pressure. The volumes of both chambers are controlled during parts of the pumping cycle by engagements of the enlargements **6*a* and 6*v* between the lower and upper walls 25 and 26 of the casing 1 and the lower and upper surfaces 28 and 27 of drive ring 10. The inner wall surface 25 of the casing is concave whereas the surface 28 of the drive ring 10 is convex. In the same way the enlargement 6*a* during part of the pumping cycle engages a convex surface 26 of the inner wall of the casing and a concave surface 27 on drive ring 10. In other words, each lens-shaped enlargement is in contact with complementary and generally dish-shaped surfaces on the inside of the casing and on the drive ring. It is possible for both sides of the drive ring to have convex form, in which case the surface of the casing engaging with enlargement 6*a*** should have a concave form, but this arrangement is not preferred because the passage between the chambers A and V would become long and cause an undesirable loss in pressure.

It is fully possible, but not preferred, to have the hose-like member 6, the casing, and the drive ring 10 in an asymmetrical shape. On the other hand, it is fully possible, and may be advantageous for certain applications, to have the inlet and the outlet of the hose-like member arranged, not in line, but at an angle.

Figure 4:
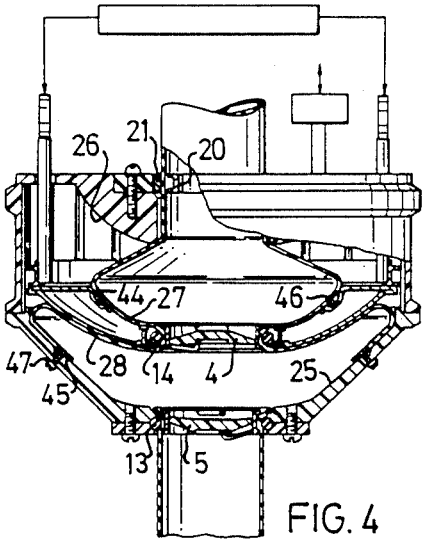
FIG. 4 shows a second embodiment in cross-sectional view taken along the axis of rotational symmetry with certain parts shown schematically.

It is also possible to omit all (or certain parts) of the flexible hose-like member 6 which during the entire pump cycle abut against wall surfaces 25 and 26, and against ring surfaces 27 and 28, in which case surfaces of the casing and the drive ring form parts of the walls of the chambers A and V. It is preferred to omit the part of the hose-like member 6 which permanently engages the lower wall 25 as well as the part of the hose-like member 6 which permanently engages with the upper surface 27 of the drive ring 10. FIG. 4 shows a second embodiment in accordance with these changes. The ends of the remaining parts of the flexible hose are secured at surfaces 27 and 25 by concentric fixtures 44 and 45 provided with a number of concentrically arranged screws 46 and 47, and at the outer groove in valves 4 and 5 as well as in ring 20 by the pressure effect of 0-rings 14, 13 and 21. The omitted parts of the flexible hose of the first embodiment have thus been replaced by parts of surfaces 25 and 27. This second embodiment is advantageous with respect to the ease of manufacture of the flexible parts of the chamber walls.

The pump can be driven by any electrical, pneumatic or mechanical driving means 17, as schematically shown in FIG. 1. The unidirectional driving force is transmitted to the drive ring 10 by a thrust collar **12*b*, which is rigidly connected to a pair of pusher rods 12*a* at opposite sides of the casing. These pusher rods pass through holes in the wall of the casing, which holes may be hermetically sealed to the rods by suitable seals (not shown). The pusher rods can be actuated by a suitable electrical motor or by a mechanical or pneumatic driving arrangement. When the driving force is acting on the pusher rods, they press down the thrust collar 12*b* so that it makes contact with the drive ring 10 and carries the drive ring with it. When the thrust collar has reached the end of its driven (pumping) stroke, it recedes from the drive ring 10** and is rapidly retracted back to the starting position by a restoring force (not shown in the drawings), which can be imparted by the motor through a transmission (e.g., cams), or by a return spring or the like.

During each pumping stroke of the thrust collar on the drive ring, the volume of chamber V is diminished and the pressure within it thus increased, which results in the closing of one-way valve 5 and the opening of one-way valve 4. Thereby medium is pumped out from the pump. Simultaneously, the volume in chamber A is able to increase so that pumping medium is taken in into the pump. When the end of the pumping stroke has been reached and the thrust collar has been retracted to the starting position, the compression of the chamber V ceases. For a short period after the pumping stroke ends, the pumped medium continues to flow out of the pump because of the kinetic energy in the direction of the outlet imparted to it during the pumping stroke. When the pressure in chamber V has decreased sufficiently valve 5 opens, and the pumped medium via passage 9 will fill chamber V. When the impulse effecting the ongoing outflow of pumping medium ceases, valve 4 closes. The static pressure of the incoming medium in combination with the kinetic pressure of the medium entering chamber V will give rise to forces directed upwardly against the lower surface 28 of the drive ring 10. The area of contact between the enlargement **6*v* and the lower surface 28 of the drive ring 10 (normalized by projection onto an imaginary plane perpendicular to the direction of movement of the drive ring 10) is then larger than the area of contact between enlargement 6*a* and the upper surface 27 of the drive ring. This results in the drive ring 10 being moved upwards and a quantity of pumped medium being transferred from chamber A to chamber V through the passage 9**. The degree of filling of chamber V is thus dependent on the pressure of the incoming pumped medium, which thereby also controls the capacity (displacement) of the pump at any given constant stroke rate (operating frequency).

One qualification for the pump to have this self-regulating function is the fulfillment of the requirement that the operation frequency must be adapted in such a way that each pumping stroke begins before the chambers A and V have reached their maximum total volume. When the maximum total volume is reached, it is evident, of course, that no more pumped medium can be taken in by the pump.

The extents to which the chambers A and V of the pump are filled during each pumping cycle are also affected by the pressure of the gas (or the like) occupying the space between the hose-like member and the casing. During each pumping stroke the volume of that space increases, and, with the casing hermetically sealed, the pressure in that volume correspondingly decreases. This decrease in pressure raises the pressure difference between the incoming pumped medium and the medium at the outside of the hose and thereby increases the inflow of pumped medium. During the return stroke the opposite is the case, in that the volume in the casing outside the hose is decreasing and the pressure correspondingly increases. The pressure outside the hose gradually approaches the pressure of the incoming medium, and the filling rate decreases. Thus a controlling effect of the pressure variations inside the casing on the filling of the chambers of the pump is obtained during the return phase of the pumping cycle. The change in pressure in the casing is determined by the relationship between the displacement volume in the pump and by the volume inside the casing. The amount of compressible fluid in the casing can be controlled by a pressure control valve 16, e.g., two one-way valves operating in opposite directions, which make possible the setting of a higher and a lower pressure inside the casing.

FIGS. 3A to 3D schematically show the embodiment at four points of the pumping cycle.

Figure 3A:
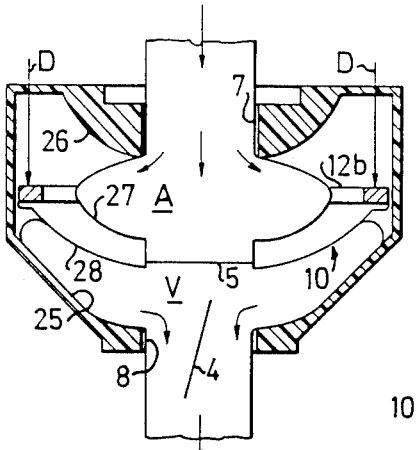
FIGS. 3A to 3D show schematically the first embodiment in different stages of the operating cycle.

FIG. 3A shows the pump at the end of the pumping stroke, that is, of the active propulsion of the thrust collar **12*b* when it has reached the limit of its downward movement as shown by arrows D, which indicate the downward force applied to the drive ring. During the downward stroke of the collar 12*b*, drive ring 10 is compressing chamber V by squeezing it against the wall 25 of the casing and reducing its volume and thereby generates a pressure in the medium in the chamber that causes it to be pumped out from the chamber through one-way valve 4. The one-way valve 5 is closed during this phase. The downward movement of drive ring 10 enlarges the space between the surface 27 of the drive ring 10 and the wall 26 of the casing so that the volume of the chamber A can increase, thereby making possible during the pumping stroke the intake of medium through inlet 7 into the chamber A. The combined total volume of chambers A and V decreases in connection with the forced stroke of thrust collar 12*b***, and the volume in the space between the hose and the casing is thereby increased so that the pressure of the gas in it will be decreasing.

Figure 3B:
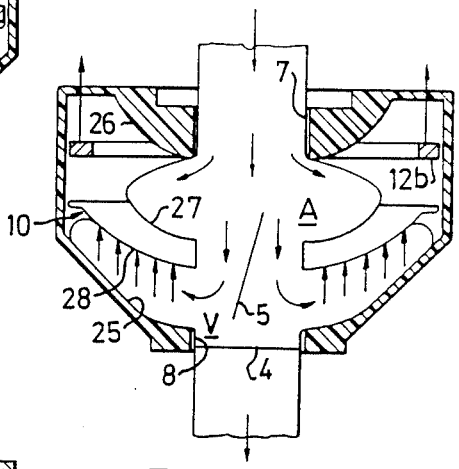

When the pumping stroke has been completed, the thrust collar **12*b* is immediately retracted, for example by a spring (not shown) forming part of the drive mean 17 (FIG. 3B). For a short time period after the thrust collar 12*b* has been retracted, the momentum of the pumped medium flowing through outlet 8 holds the valve 4 in an open position, and additional medium will therefore leave chamber V. However, the hydrostatic pressure in the chamber V will rapidly decrease, which causes the valve 5 to open under the action of the static and hydrodynamic pressure of the medium flowing into chamber A. In consequence, the flexible walls in the enlargement 6***v* exert a pressure force on surface 28 at the under side of the drive ring 10. A pressure force of the same type, although smaller because of the lesser area of engagement, will be exerted on the walls of the enlargement 6*a* at the upper surface 27 of the drive ring. A net upward force component during the time period between active pump strokes thus results. This net force component makes the drive ring 10 rise.

The convex surface 26 of the casing progressively engages more of the adjacent portions of enlargement 6*a* when the drive ring 10 moves in the direction of said surface, and the differential decrease of the volume in enlargement 6*a* is approaching the differential increase of the volume in enlargement 6*v*. In a certain point, both become equal. The upward movement thus ceases, no matter how large the pressure difference may be between chambers A and V, on the one hand, and between the chambers and the space surrounding them, on the other. This arrangement of surfaces affecting chambers A and V in such a way that their maximum volume is reached before drive ring 10 has moved to the upper point of arrival in the direction of the inlet has a protecting effect with respect to the flexible material in hose 6, this effect being especially advantageous when the pump is working continuously in the form of an embodiment with a casing not hermetically sealed against the ambient atmosphere, i.e., at atmospheric pressure.

Figure 3C:
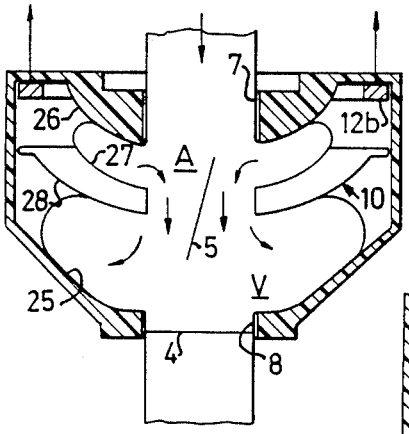
Figure 3D:
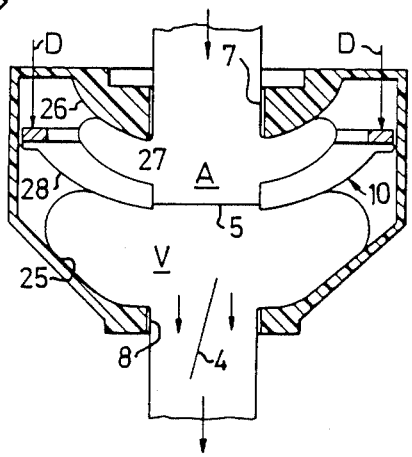

As shown in FIG. 3C, the force of the inflowing medium acting upwards raises the drive ring and allows the volume in chamber V to increase. The size and geometry of both chambers is such that even when the volume of chamber A is decreasing, the total combined volume of A and V increases. The higher the position of drive ring 10, the larger the total combined volume of the chambers, and the larger the increase of pressure within the casing. Before the drive ring reaches the position where the total volume of the chambers attains its maximum (in cases of the pressure within the casing being kept constant) or, when the pressure in chambers A and V, on the one hand, and the pressure in the space surrounding them, on the other hand, have become equal (the pressure in the casing varying dependent on the volume of chambers A and V and their dependence on the static and dynamic forces of the incoming medium), the next pump stroke is started by the downward movement of thrust collar 12*b* through the force effected by the drive means (arrows D) as shown in FIG. 3D. At a higher stroke rate, dynamic forces will become more important, and equilibrium is no longer attained, but the pumping effect nevertheless will be proportional to the pressure of the pumped medium at the inlet side of the pump.

The pump may be used in various ways. It may be made immersible by surrounding it with a flexible polymer bag which, in addition to enclosing it, has the function of an outer closed volume enabling exchange of fluid in the casing surrounding hose 6 by means of a pressure control valve 16 according to FIG. 1. Pressure control valve 16 may, e.g., be given the form of two one-way valves, one in each direction, which connect the space inside the casing with the space between the casing and the polymer bag, and which valves may have preset opening and closing pressure levels. The polymer bag has been indicated in FIG. 1 by dashed line 35.

The pump can be provided with means for the detection of the highest position of the drive ring 10 during a pumping cycle, for example in order to control the stroke rate of the pump.

The invention thus provides a pump in which a valve plane is raised by the forces of the incoming medium, that is, the fluid pressure and the dynamic forces which result from the active phase of the pumping cycle. When the valve plane has reached its lowest position and is about to start its return movement due to the continuing inflow of the medium, the valve functions as a collapsible wall moving in a direction counter to that of the inflowing medium until a new stroke starts. The valve at the outlet closes as soon as the flow through it ceases which, depending on flow rate, may be later than the moment when the valve plane in the pump has reached its lowest position. The higher the stroke rate, the more the dynamic forces in the flowing medium will affect the pumping function, though not violating the basic principle that the pressure of the inflow side controls output.

I claim:

1. A pump with continuous inflow and pulsating outflow having first and second chambers with flexible walls, a passage arranged between the two chambers with a first one-way valve enabling flow only from the first chamber to the second chamber, an intake tube to the first chamber, an output tube to the second chamber, a one-way valve in the output tube enabling flow only from the second chamber, a motor, drive means coupled to the motor for changing the volume of the second chamber, and a casing enclosing the chambers with the intake tube and the output tube emanating from the casing through openings in it and secured in the openings, characterized in that the drive means includes a drive ring that is fastened to the passage between the chambers and, together with the passage and the flexible walls of the chambers, is freely movable inside the casing in such a way that motion of the drive ring in the direction towards the outlet of the second chamber causes the volume of the second chamber to decrease by expulsion of pumped medium through the outlet from the second chamber while the first chamber is able to increase in volume to allow pumped medium to be taken in, and in that the drive ring has surfaces that during a pumping cycle engage varying areas of the walls of the respective first and the second chambers in such a way that the pressure of the incoming medium controls the flow in the pump by determining the extent of the return movement of the drive ring as a function of the pressure forces acting over the areas of engagement between the drive ring and the respective chambers.

2. A pump according to claim 1, characterized in that the drive means includes power transmission means for imparting a force on the drive ring only in one direction and for disengaging the motor from the drive ring and returning to a start position in the other direction.

3. A pump according to claim 1, characterized in that the pump casing is hermetically sealed and contains a compressible fluid between the chambers and the casing, the pressure of which varies as a function of the variation in total volume of the chambers, which pressure thereby affects the inflow of the pumped medium.

4. A pump according to claim 3, characterized in that it includes means for control of the pressure within the casing.

5. A pump according to claim 4, characterized in that it further comprises an enclosure containing part of or all of the pump casing together with the means for control of the pressure in the casing, which control means includes a passage between the casing and the enclosure.

6. A pump according to claim 1, characterized in that the chambers and the passage between them are part of a hose-like member made of flexible and substantially nonelastic material.

7. A pump according to claim 1, characterized in that the chambers are made entirely from a flexible and substantially non-elastic material.

8. A pump according to claim 1, characterized in that the surface of the drive ring engaging with one chamber is convex and the surface of the drive ring engaging with the other chamber is concave.

9. A pump according to claim 8, characterized in that a wall portion of each chamber during parts of the pumping cycle engages with a portion of the inner wall of the casing, said casing wall portion being complementary in shape to the drive ring surface facing it.

10. A pump according to claim 1, characterized in that there are portions of the chamber walls that are, during a pumping cycle, always in contact with part of the inner wall of the casing or with a surface of the drive ring and in that such portions of the chamber walls are also portions of the inner wall of the casing or said surface of the drive ring.

11. A pump with continuous inflow and pulsating outflow having a casing enclosing first and second chambers with flexible walls and containing a compressible fluid in the space between the casing inner wall and the walls of said chambers, a passage with a first one-way valve arranged between the chambers, an intake tube to the first chamber penetrating the casing and secured to it, an outlet tube from the second chamber penetrating the casing and secured to it, a second one-way valve arranged in the outlet tube, a motor, and means for changing the volume of the chambers coupled to the motor, characterized in that said means includes a drive ring mounted at said passage and surrounding it, the surface of the drive ring facing the first chamber being concave with respect to that chamber and the surface of the drive ring facing the second chamber being convex with respect to that chamber, which surfaces partially engage with wall portions of the respective chambers, and further comprising a convex casing inner wall portion facing the first chamber, which wall portion is arranged symmetrically around the inlet and engages with part of the wall of said chamber, and a concave casing inner wall portion facing the second chamber, which wall portion engages with part of the wall of said chamber.

12. A pump according to claim 11, characterized in that said means includes a thrust collar and means for coupling the motor to the thrust collar to impart unidirectional forced displacement of the drive ring toward the concave casing wall portion and to impart immediate retraction and disengagement from the drive ring at the end of said forced displacement.

13. A pump according to claim 11, characterized in that the casing is hermetically sealed.

14. A pump according to claim 13, characterized in that there is means for control of the pressure of a gas within the casing.

15. A pump according to claim 14, characterized in that there is an enclosure enclosing part of or all of the pump casing together with the means for control of the pressure in the casing, which control means includes a passage between the casing and said enclosure.

16. A pump according to claim 11, characterized in that the intake tube, the outlet tube, the chambers, and the passage between the chambers are parts of a hose-like member made of flexible, substantially non-elastic material.

17. A pump according to claim 11, characterized in that parts of the walls of the chambers are also portions of the inner casing wall and the drive ring surface.

18. A pump according to claim 16, characterized in that the chambers when enlarged and not restricted in their expansion take the approximate forms of a biconvex lens or a sphere.

19. A pump according to claim 17, characterized in that the flexible walls of the chambers take the approximate forms of portions of a biconvex lens or a sphere.

20. A pump according to claim 11, characterized in that the volume of the first chamber is smaller than that of the second chamber.

21. A pump according to claim 19, characterized in that the volume of the first chamber is smaller than the volume of the second chamber.

* * * * *